US005096211A

United States Patent [19]

Morais

[11] Patent Number: 5,096,211

[45] Date of Patent: Mar. 17, 1992

[54] DART GAME APPARATUS

[76] Inventor: Richard A. Morais, 8000 SW. 149th Ave., Apt. 205, Miami, Fla. 33193

[21] Appl. No.: 657,148

[22] Filed: Feb. 19, 1991

[51] Int. Cl.[5] ..... F42B 6/00

[52] U.S. Cl. ..... 273/420

[58] Field of Search ..... 273/419, 420, 423; 124/62

[56] References Cited

U.S. PATENT DOCUMENTS

| | | | |
|---|---|---|---|
| 1,956,875 | 5/1934 | Paradise | 273/419 X |
| 2,821,397 | 1/1958 | Hartigan, Sr. | 124/62 X |
| 3,433,210 | 3/1969 | Schnitz | 124/62 |

FOREIGN PATENT DOCUMENTS

| | | | |
|---|---|---|---|
| 2702563 | 7/1978 | Fed. Rep. of Germany | 124/62 |
| 208199 | 1/1940 | Switzerland | 124/62 |
| 198201 | 5/1923 | United Kingdom | 273/420 |
| 510193 | 7/1939 | United Kingdom | 273/420 |
| 2224452 | 5/1990 | United Kingdom | 273/419 |

OTHER PUBLICATIONS

Sporting Goods Dealer 1-1972, p. 45 Malayan Blow Gun.

*Primary Examiner*—Paul E. Shapiro

*Attorney, Agent, or Firm*—Leon Gilden

[57] ABSTRACT

An elongate blow gun defined by a tubular barrel, with a concave resilient entrance ring receiving in a sealing relationship a dart member therewithin. The dart member, through pneumatic pressurization by an individual, directs the dart member as a projectile towards a target board, including alternating and contrasting target sections thereon. A modification of the invention includes a dart member defined by triangular stabilizing vanes that in a first position position each hypotenuse edge of each stabilizing vane in contiguous communication against a conical side wall surface of the dart member that pivots rearwardly upon ejection of each modified dart member from the barrel to enhance stabilization of the dart member during its trajectory towards the target board.

5 Claims, 4 Drawing Sheets

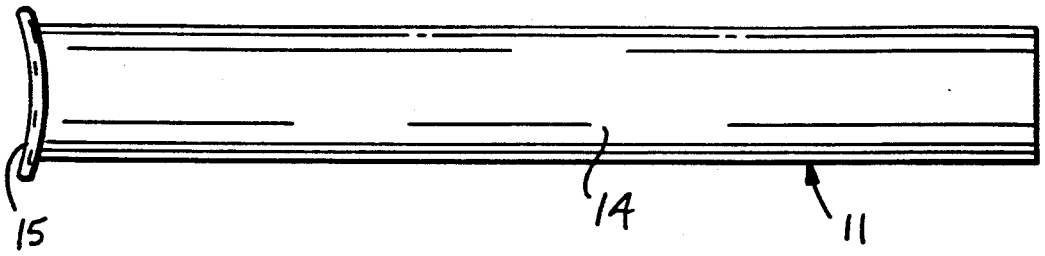
Fig 3
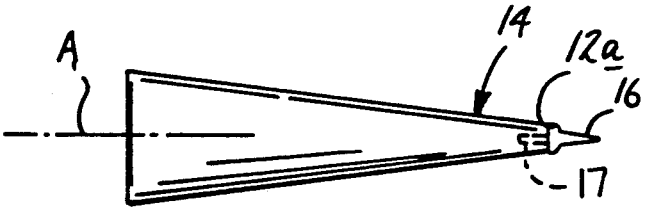
Fig 4
Fig 5
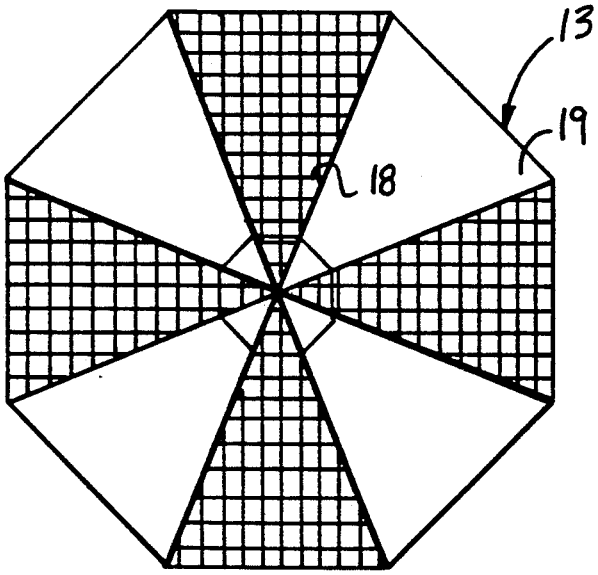

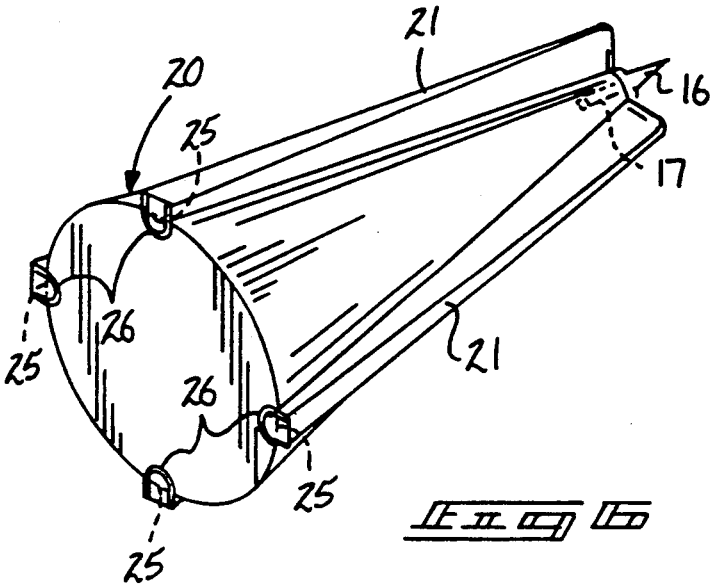
Fig 6
Fig 7
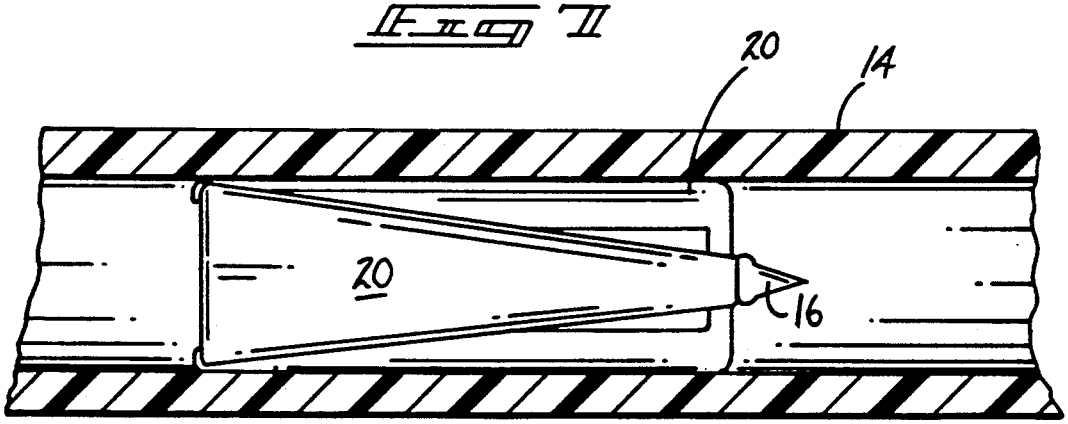

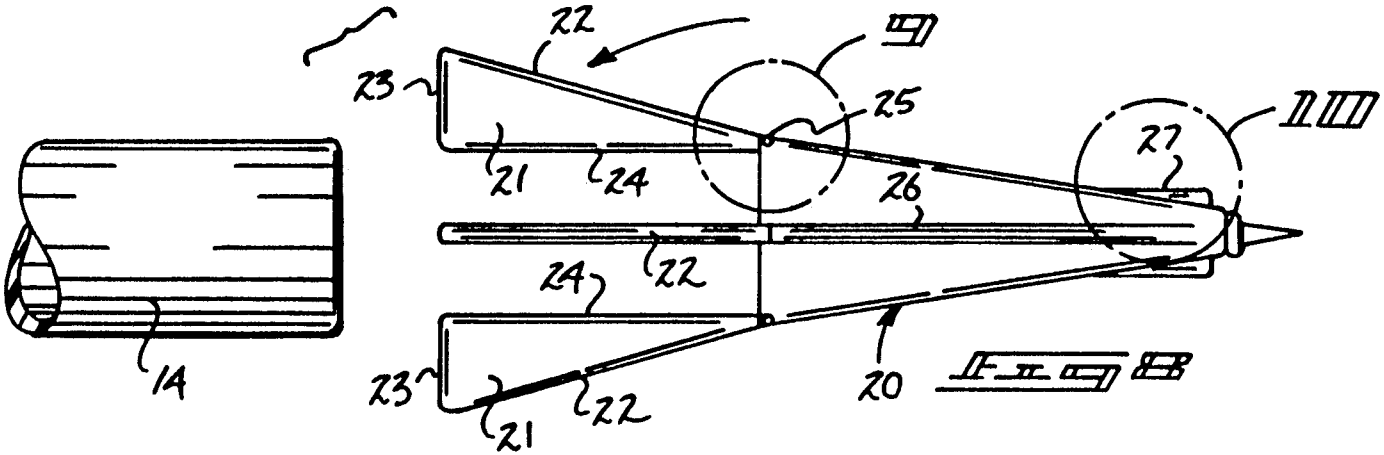
FIG. 8
FIG. 9
FIG. 10
FIG. 11
11
9
25
26
27
20
22
24
21
23
14
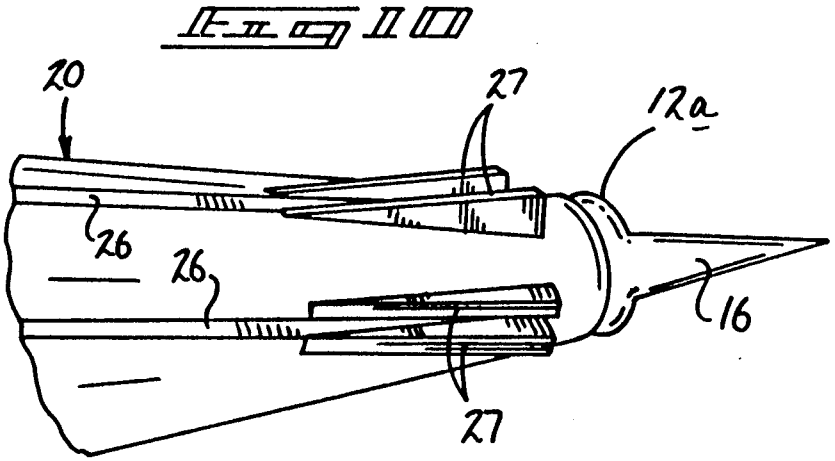
12a
16
27
26
20
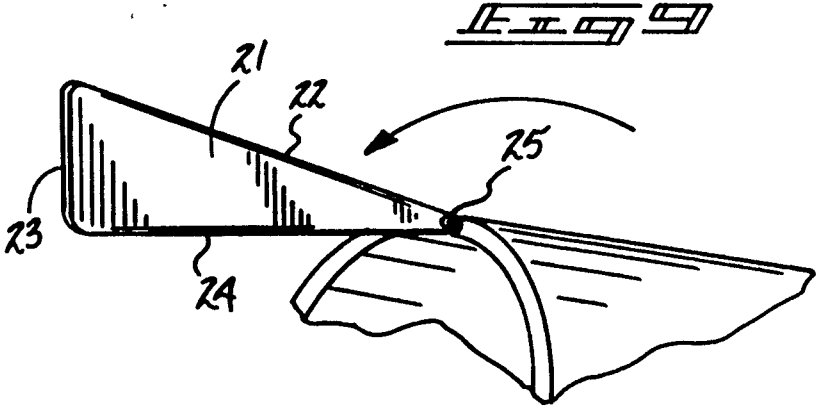
25
22
21
24
23

DART GAME APPARATUS

BACKGROUND OF THE INVENTION

1. Field of the Invention

The field of invention relates to dart game apparatus, and more particularly pertains to a new and improved dart game apparatus wherein the same directs projectiles against a target board.

2. Description of the Prior Art Darts of various types have been utilized in the prior art. To enhance simplicity, a blow gun may be utilized as set forth in U.S. Pat. No. 4,054,120 to Foley to project an associated projectile towards a target board.

U.S. Pat. No. 4,419,978 to Loftus sets forth a blow gun assembly mounting projectiles within a quiver affixed about the barrel of the gun member.

U.S. Pat. No. 3,190,654 to Ross sets forth a dart member utilizing coaxially mounted rigid vanes directed rearwardly of the central plug of the dart member for reception with the blow gun member.

U.S. Pat. No. 4,537,176 to Stravitz, et al. sets forth a further dart game apparatus utilizing fixed vane projectiles for directing each projectile through an associated blow gun member.

U.S. Pat. No. 3,266,806 to Warren, et al. sets forth a blow gun member utilizing a dart-like projectile including a hollow needle for injecting a liquid into an animal upon impact.

As such, it may be appreciated that there continues to be a need for a new and improved dart game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of dart game apparatus now present in the prior art, the present invention provides a dart game apparatus wherein the same provides self-stabilizing projectiles directed under pneumatic pressure through an associated blow gun barrel. As such, the general purpose of the present invention, which will be described subsequently in greater detail, is to provide a new and improved dart game apparatus which has all the advantages of the prior art dart game apparatus and none of the disadvantages.

To attain this, the present invention provides an elongate blow gum defined by a tubular barrel, with a concave resilient entrance ring receiving in a sealing relationship a dart member therewithin. The dart member, through pneumatic pressurization by an individual, directs the dart member as a projectile towards a target board, including alternating and contrasting target sections thereon. A modification of the invention includes a dart member defined by triangular stabilizing vanes that in a first position position each hypotenuse edge of each stabilizing vane in contiguous communication against a conical side wall surface of the dart member that pivots rearwardly upon ejection of each modified dart member from the barrel to enhance stabilization of the dart member during its trajectory towards the target board.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purpose of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dart game apparatus which has all the advantages of the prior art dart game apparatus and none of the disadvantages.

It is another object of the present invention to provide a new and improved dart game apparatus which may be easily and efficiently manufactured and marketed.

It is a further object of the present invention to provide a new and improved dart game apparatus which is of a durable and reliable construction.

An even further object of the present invention is to provide a new and improved dart game apparatus which is susceptible of a low cost of manufacture with regard to both materials and labor, and which accordingly is then susceptible of low prices of sale to the consuming public, thereby making such dart game apparatus economically available to the buying public.

Still yet another object of the present invention is to provide a new and improved dart game apparatus which provides in the apparatuses and methods of the prior art some of the advantages thereof, while simultaneously overcoming some of the disadvantages normally associated therewith.

Still another object of the present invention is to provide a new and improved dart game apparatus wherein the same employs stabilizing dart members including vanes to enhance stabilizing of a trajectory of an associated dart member during flight thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view, taken in elevation, of the blow gun member of the instant invention.

FIG. 4 is an orthographic side view, taken in elevation, of a dart member utilized by the instant invention.

FIG. 5 is a top plan view of the target board utilized by the instant invention.

FIG. 6 is an isometric illustration of a modified dart member utilized by the instant invention.

FIG. 7 is an orthographic side view, partially in section, illustrating the modified dart member directed through the barrel of the blow gun member.

FIG. 8 is an orthographic side view, taken in elevation, of the modified dart member ejected from the associated blow gun barrel.

FIG. 9 is an enlarged isometric illustration of section 9 as set forth in FIG. 8.

FIG. 10 is an illustration of Section 10 as set forth in FIG. 8.

DESCRIPTION OF THE PREFERRED EMBODIMENT

Figure 1:
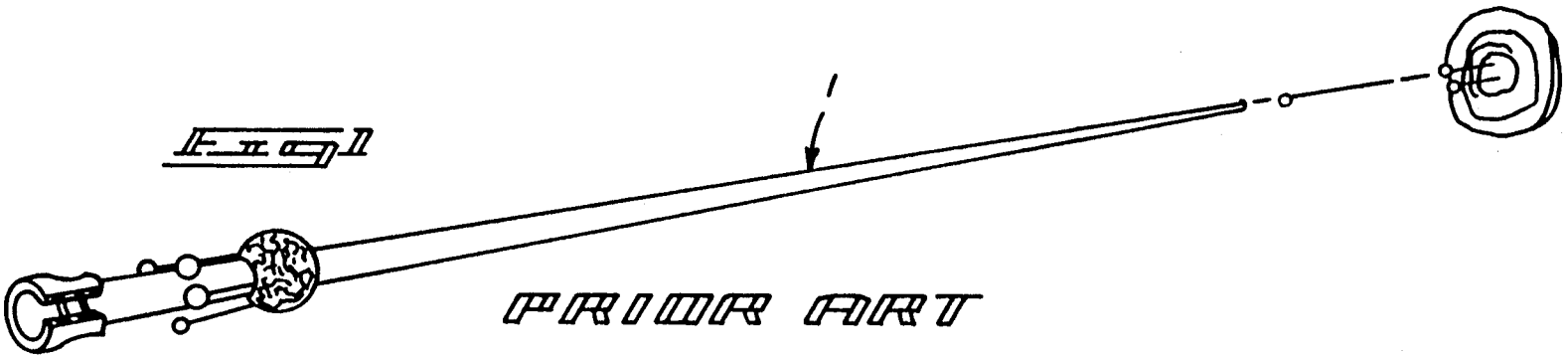
FIG. 1 PRIOR ART
FIG. 1 is an isometric illustration of a prior art dart game apparatus.

With reference now to the drawings, and in particular to FIGS. 1 to 10 thereof, a new and improved dart game apparatus embodying the principles and concepts of the present invention and generally designated by the reference numerals 11 through 27 will be described.

Figure 2:
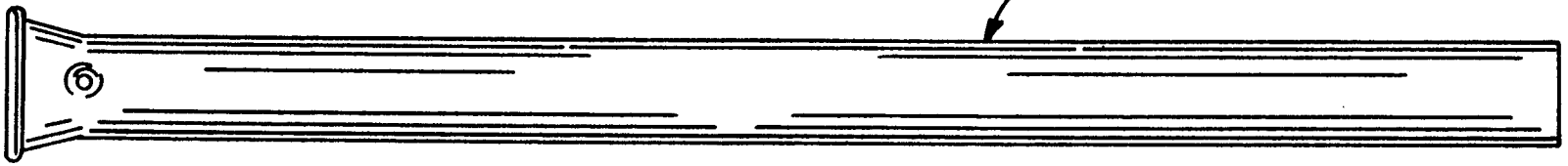
FIG. 2 PRIOR ART
FIG. 2 is an orthographic side view, taken in elevation, of a prior art blow gun member utilized with associated darts.

FIG. 1 illustrates a prior art dart gun apparatus 1, as set forth in U.S. Pat. No. 4,419,978, illustrating a barrel mounting a series of pin-type projectiles for protecting the projectiles against an associated target. FIG. 2 illustrates a further example of a prior art dart game organization employing a blow gun member 2, as set forth in U.S. Pat. No. 4,054,120.

More specifically, the dart game apparatus of the invention essentially comprises a blow gun 11, including a dart member 12 positionable therewithin. The dart member is defined by a truncated conical body, with a planar base receivable within a tubular barrel 14 of the blow gun 11. A concave resilient entrance ring 15 effects a sealing relationship between an individual's mouth to direct pneumatic pressure to the planar base of the dart member 12. The planar base is orthogonally oriented relative to an axis "A" of the conical body. A target board 13 is provided, of a generally octagonal configuration, including alternating and contrasting dark and light triangular sections 18 and 19 respectively. Various point total enumerations may be arbitrarily awarded each of the sections to permit alternating players to vie for point totals.

A dart member 12 includes a removable tip 16 mounted within a forward terminal end of the dart, wherein the removable tip 16 includes a tip shank 17 that is receivable within a complementarily configured bore coaxially directed along the axis "A" of the dart member 12 remote from the planar base.

FIGS. 6–10 illustrate the use of a modified dart member 20, wherein the conical body includes a plurality of right triangular stabilizing vanes 21 that are spaced 90 degrees apart about the conical side wall of the dart member 20. Each vane includes a hypotenuse edge 22 that is positioned in contiguous communication with the conical side wall of the dart member in a first position, wherein the hypotenuse rotates relative to the conical side wall about a pivot axle 25 that is mounted at the inner face of the conical side wall and the planar base, as illustrated in FIG. 9 for example. Each right triangular stabilizing vane 21 includes a first leg 23 of a first length, and a second leg 24 of a second length, wherein the second length is greater than the first length and wherein the first leg is arranged orthogonally relative to the second leg. Upon rotation of each stabilizing vane 21, the first leg 23 is oriented generally orthogonally relative to the axis of the conical body and wherein each second leg 24 is arranged parallel to the axis "A" and parallel to each second leg 24 of the remaining vanes. As illustrated in FIG. 6 for example, the pivot axle 25 is orthogonally directed through each vane 22 adjacent an intersection of the hypotenuse edge 22 and the second leg 24 within a groove 26 that is coextensively formed along the body, as illustrated in FIG. 10 for example. Each groove 26 that is coextensively directed along the conical body is coextensively aligned with each stabilizing vane 21 to maintain alignment of the vane in the first position and guide the vane from the first position to the second position, as illustrated in FIG. 9. Further, plural pairs of spaced parallel positioning ribs 27 are positioned adjacent the forward end 12*a* of the dart member 20 to enhance positioning of the hypotenuse edge 22 within the groove and minimize fluctuation or a feathering of the vane during its projection through the tubular barrel 14 of the blow gun 11.

Upon rotation of each vane from the first to the second position as set forth in FIGS. 7–8 respectively, the vanes enhance stability within the barrel 14 and during its subsequent flight to the associated target bore 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dart game apparatus comprising, in combination, a blow gun, the blow gun including an elongate tubular barrel, and at least one dart member complementarily receivable within the tubular barrel, and the dart member defined by a truncated conical body, the conical body defined by an axis, and the conical body including a planar base, the planar base orthogonally oriented relative to the axis to receive pneumatic pressure thereon when positioned within the tubular barrel, and the conical body including a forward end coaxially aligned relative the the conical body, and the forward end removably mounting a tip, the tip including a shank, and the shank slidably and complementarily receivable within a bore directed within the conical body coaxially aligned with the conical body to coaxially align the tip on the forward end of the conical body, and wherein the dart member includes a plurality of right triangular stabilizing vanes pivotally mounted to the conical body at an intersection of the conical body, and each vane including a hypotenuse edge in contiguous communication with the conical body in the first position when the dart member is directed through the tubular barrel, and pivotal to a second position rearwardly of the conical body when the dart member is projected exteriorly of the tubular barrel.

2. An apparatus as set forth in claim 1, wherein each vane includes a first leg defined by a first length and a second leg defined by a second length, wherein the second length is greater than the first length and th first leg is orthogonally oriented relative to the second length, and wherein the first leg is oriented orthogonally relative to the axis in the first position and the second position, and wherein the second leg is oriented parallel relative to the axis in the second position.

3. An apparatus as set forth in claim 2, wherein a pivot axle is directed through each vane orthogonally through each vane at an intersection of the hypotenuse edge and the second leg.

4. An apparatus as set forth in claim 3, wherein the dart member includes an elongate groove directed coextensively of the conical body in alignment with each vane to receive the hypotenuse edge within each respective groove, and each vane and each groove are displaced ninety degrees about the conical body.

5. An apparatus as set forth in claim 4, wherein each groove includes a pair of spaced, parallel positioning ribs mounted radially relative to the conical body adjacent the forward end of the dart member to maintain alignment of each vane when in the first position directed through the tubular barrel.

* * * * *